United States Patent [19]

Baughman

[11] 4,013,295

[45] Mar. 22, 1977

[54] GOLFER'S POSITIONING AND RETRIEVING DEVICE

[76] Inventor: George Washington Baughman, 106 Interlachen Ave., Winter Park, Fla. 32789

[22] Filed: Sept. 12, 1975

[21] Appl. No.: 612,935

[52] U.S. Cl. ..... 273/162 E; 273/33; 294/19 A

[51] Int. Cl.[2] ..... A63B 57/00; A47F 13/06

[58] Field of Search ..... 273/32 F, 162 E, 33; 294/19 A

[56] References Cited

UNITED STATES PATENTS

| | | | |
|---|---|---|---|
| 683,244 | 9/1901 | Boda et al. | 273/33 |
| 724,814 | 4/1903 | Cohen | 294/19 A |
| 1,452,679 | 4/1923 | Fisher | 294/19 A |
| 1,696,817 | 12/1928 | St. John | 294/19 A |
| 2,834,629 | 5/1958 | Williams | 294/19 A |
| 2,943,856 | 7/1960 | Eimerman | 273/33 |
| 3,669,427 | 6/1972 | Curtis | 294/19 A |
| 3,904,200 | 9/1975 | Jackle et al. | 273/33 |
| 3,922,027 | 11/1975 | Nesselt | 294/19 A |

*Primary Examiner*—George J. Marlo
*Attorney, Agent, or Firm*—Harold A. Williamson, Sr.

[57] ABSTRACT

A portable golf ball teeing and golf ball retrieving apparatus for use with a golf ball, tee and golf club handle. The apparatus is comprised of a pair of golf ball and tee gripping members which have resiliently biased latching elements secured to the gripping members to hold the gripping members in either a golf ball and tee gripping position or in a release position. A gripping and position control unit mechanically is coupled to the gripping members so that initial downward pressure on the gripping and position control unit allows the ball and tee to be positioned with the tee in the ground and the ball positioned thereupon. The application of further downward pressure on the gripping and position control unit causes the gripping members to release the ball and tee. In the event that a ball is being retrieved, the gripping members are in a released position and the apparatus is placed with the gripping members adjacent the ball with a portion of the apparatus in contact with the ball. Downward pressure on the gripping and control unit in excess of that employed during the ball positioning and release will cause the gripping members to assume a ball gripping position.

10 Claims, 6 Drawing Figures

GOLFER'S POSITIONING AND RETRIEVING DEVICE

This invention relates to a portable object gripping, positioning and retrieving apparatus.

More specifically, this invention relates to a portable golf ball teeing and golf ball retrieving apparatus for use with a golf ball, tee and golf club handle. The apparatus is comprised of a pair of golf ball and tee gripping members which have associated therewith a resiliently biased latching means secured to the gripping members to hold the gripping members in either a golf ball and tee gripping position or in a release position. There is provided a gripping and position control unit mechanically coupled to the gripping members so that initial downward pressure on the gripping and position control unit allows the ball and tee to be positioned with the tee in the ground and the ball positioned thereupon. The application of further downward pressure on the gripping and position control unit causes the gripping members to release the ball and tee. In the event that a ball is being retrieved, the gripping members are in a released position and the apparatus is placed with the gripping members adjacent the ball with a portion of the apparatus in contact with the ball. Downward pressure on the gripping and control unit in excess of that employed during the ball positioning and release will cause the gripping members to assume a ball gripping position.

Over the years those men and women who have pursued the sport of golf more frequently than not find that golfing has become a way of life. This way of life and the physical demands of the sport, especially the stooping to place a ball on the tee and retrieving a ball after play is completed, becomes burdensome as the player's years advance. The loss of suppleness in the player's back, as well as back problems in younger players, has forced many devotees of the sport to abandon this way of life. This is most unfortunate because this sport, with the exception of ball positioning and retrieving, is a longevity inducing activity. This problem of ball retrieving and positioning has been pursued in the past and a number of partial solutions have been evidenced in the prior art. This prior art approaches have been commendable attempts, however, it is believed that a basic set of criteria should have been considered prior to the design of this type of device. And what are some of these criteria not simultaneously found in any single device of this nature in the past? The first criteria objective should be that the device is small enough to be carried in one's pocket and capable of being applied to a club handle readily. In one use, namely, that of picking up the ball, the device of this invention would be attached to the handle of a putter. When teeing a ball, the device would be attached to handle of the driver or any other club that might be used for driving the ball.

Another criteria and a prime objective is that the device should require no modification to any club to which it is attached.

Yet another object of this invention is the desirability of the device being free from triggers, buttons or other devices extending along the handle of a club for the remote control of the device.

Still another criteria or objective is that the device should operate in response to simple action from the golf club to which it is attached.

The device to be described and the invention involved therein meets all these criteria and has as its objectives those enumerated above.

In the attainment of the foregoing objects the invention contemplates in its broadest sense the provision of a portable object gripping, positioning and retrieving apparatus for use with any elongated unit having a free end of a configuration that will physically cooperate with the apparatus. The apparatus is comprised of a main body and an object gripping and positioning mechanism. The main body has an upper and a lower portion, with the upper portion having a concave opening to provide a mating gripping configuration when the apparatus is pressed into engagement with the free end of the elongated unit. The lower portion of the main body has a plurality of cavities suitable for the retention of a plurality of resilient control elements. Each of the cavities has enclosed therein a resilient control element. A pair of these cavities have movable control members. Positioned between the pair of cavities is a cavity which includes an object contact member. The movable control members and the object contact member are positioned in the cavities in abutting relationship to the resilient control elements for reciprocating movement within the cavities. Each of the movable control members have a pivotal connection at a point remote from the control members abutting contact with the resilient control elements.

The object gripping and positioning mechanism noted earlier includes a pair of object gripping members, each having a pivotal connection configuration at an upper end which is mechanically coupled to the pivotal connection of the movable control members. The object gripping and positioning members have a lower end provided with an object gripping configuration portion when the object gripping and positioning members are deposed in a substantially parallel relationship. The object gripping and positioning members have connected there between a resilient member, which resilient member urges the object gripping members toward each other to thereby ensure the gripping of the object by the object gripping configuration portion of the members.

A latching mechanism is also provided, which mechanism is deposed between and connected to the object gripping and positioning members to provide an open object gripping position and a closed object gripping position whereby the object is gripped and released depending upon a force transmitted through the apparatus from the elongated unit. In the preferred embodiment of the invention the object gripping configuration lower end portion is of a shape that provides for a simultaneously mating engagement with a golf ball and tee.

Other objects and advantages of the present invention will become apparent from the ensuing description and illustrative embodiment thereof, in the course of which reference is made to the accompanying drawings in which.

A description of the above embodiments will follow and then the novel features of the invention will be presented in the appended claims.

Figure 1:
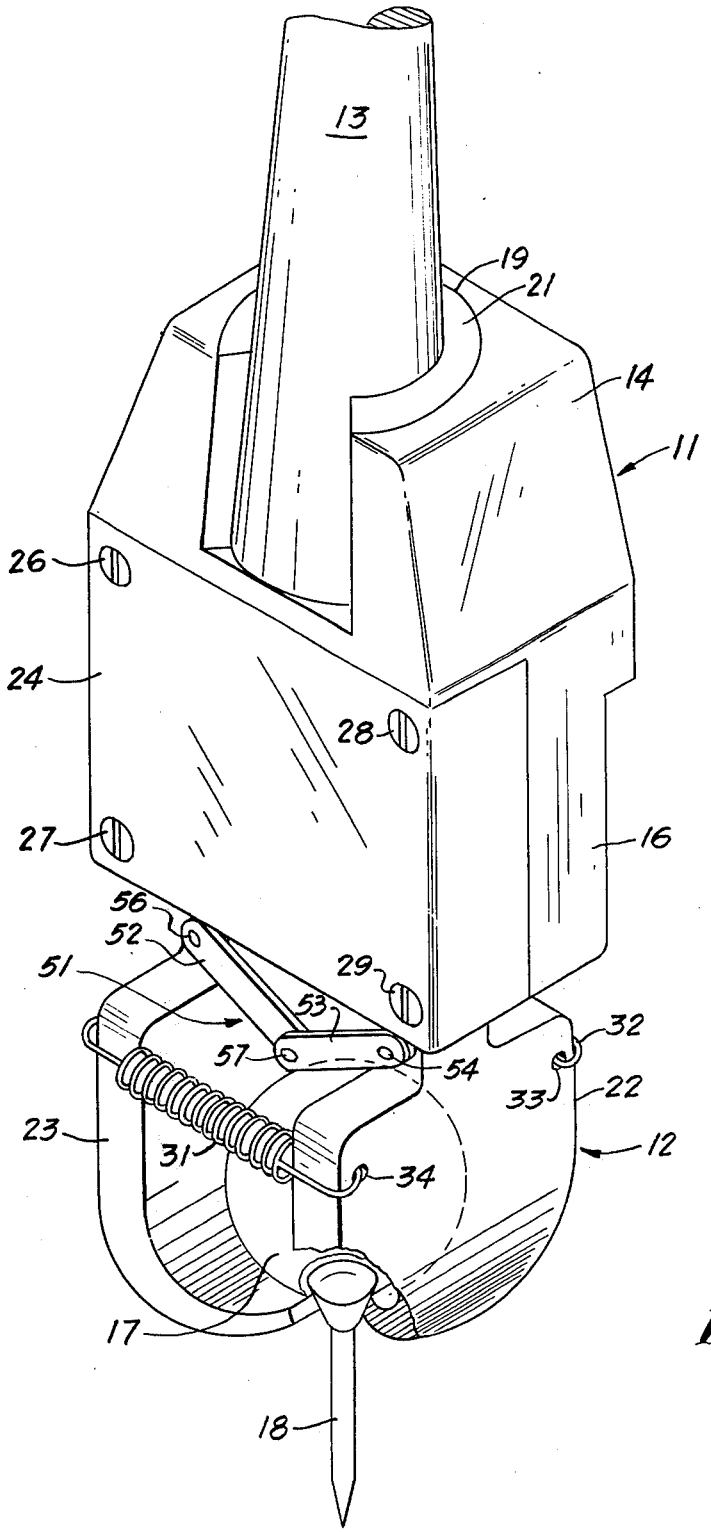
FIG. 1 is a three-dimensional illustration of the golf ball teeing and retrieving apparatus of the invention.

Reference is now made to FIG. 1 which illustrates the portable golf ball teeing and ball retrieving apparatus of this invention. The apparatus is comprised of a main body 11 which has extending therefrom an object gripping and positioning mechanism 12. In the upper portion of FIG. 1 there can be seen a portion of golf club handle 13 snugly fitted into a concave opening 19 having a tapered shape in the upper body portion 14. As with most golf club handles, there is a shape to the handle 13 that is tapered to some degree. In order that the portable apparatus of the invention fits securely to a variety of golf handles or the free end of any elongated unit, there is provided within the concave opening 19 a resilient lining material 21. This resilient material will conform to a variety of shaped units. The main body 11 as well as almost all of the other components may be formed of plastic or other suitable light weight material.

The lower body portion 16 has secured thereto a cavity cover 24 secured by screws 26, 27, 28 and 29. A study of FIG. 2, FIG. 3 and FIG. 4 to be made hereinafter will explain the details of construction of the lower body portion 16 as well as the operation of the components housed in cavities 36, 37, 38 of FIG. 2.

The object gripping and positioning mechanism 12 is comprised of a pair of object gripping members 22, 23 which have secured thereto a pair of springs 31, 32. These springs 31, 32, or resilient members as they may be termed, are secured at their ends by cooperation with openings 33, 34, for example, in object gripping member 22.

In the preferred embodiment of the invention the object gripping members 22, 23 simultaneously grip a golf ball 17 and tee 18.

The object gripping and positioning mechanism further includes a latching mechanism 51 which includes a pair of links 52, 53 connected to each other by pivot pin 57 and to object gripping members 22, 23 by pivot pins 54, 56 respectively.

The latching mechanism 51 works in conjunction with springs 31, 32 to provide what will be described more fully hereinafter as an over center latching function to provide the apparatus of the invention with a releasable gripping position as well as open or object release position.

Figure 4:
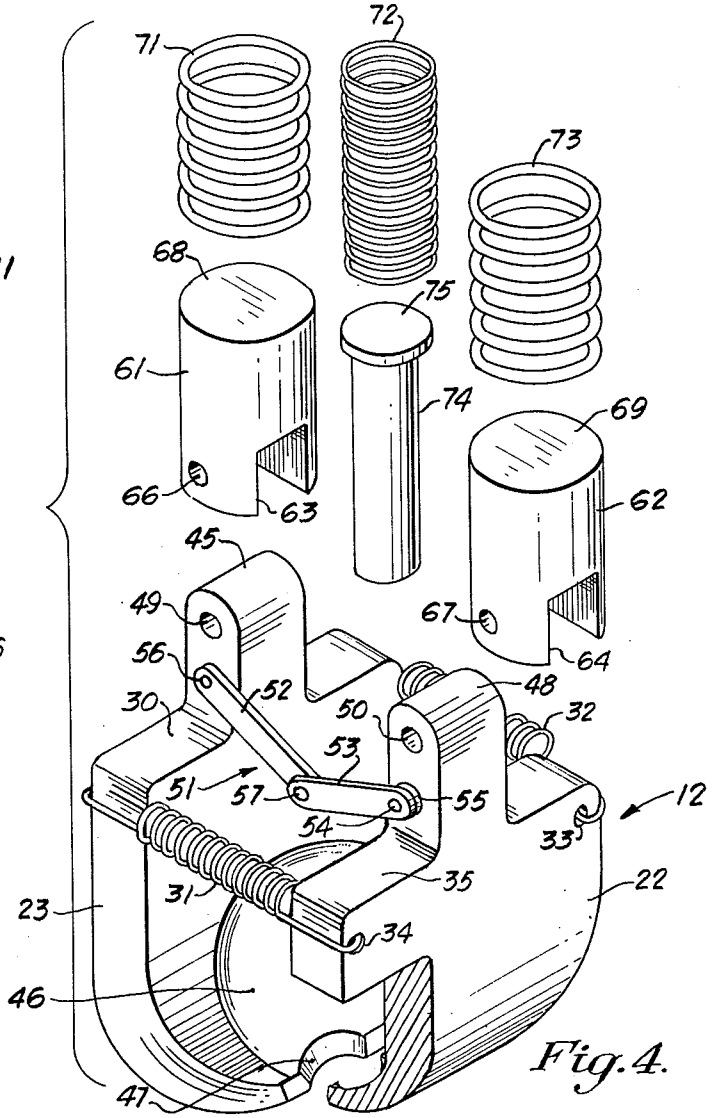
FIG. 4 is a spaced apart illustration of the internal components of the main body of the apparatus containing the invention as well as a detailed illustration of the object gripping mechanism.
Figure 2:
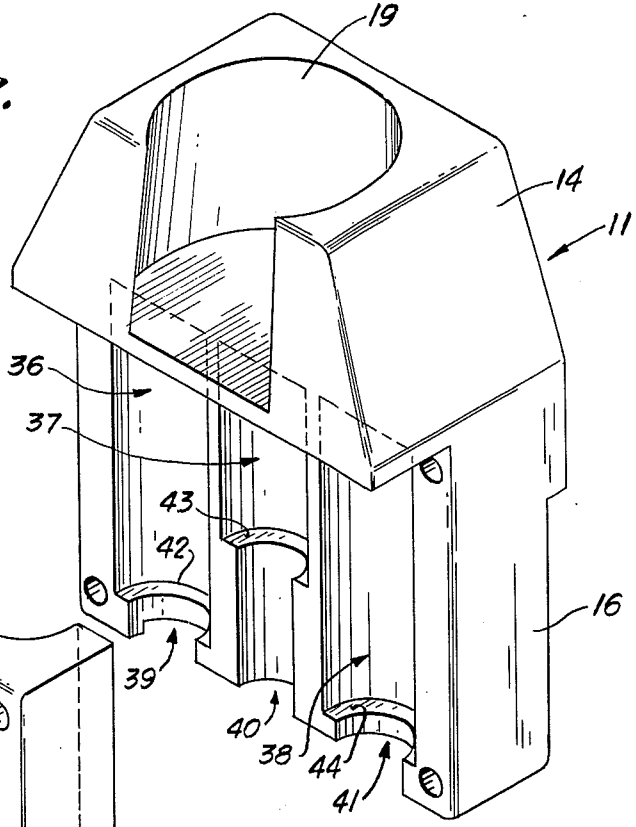
FIG. 2 is a three-dimensional showing of a portion of the main body of the apparatus containing the invention.
Figure 3:
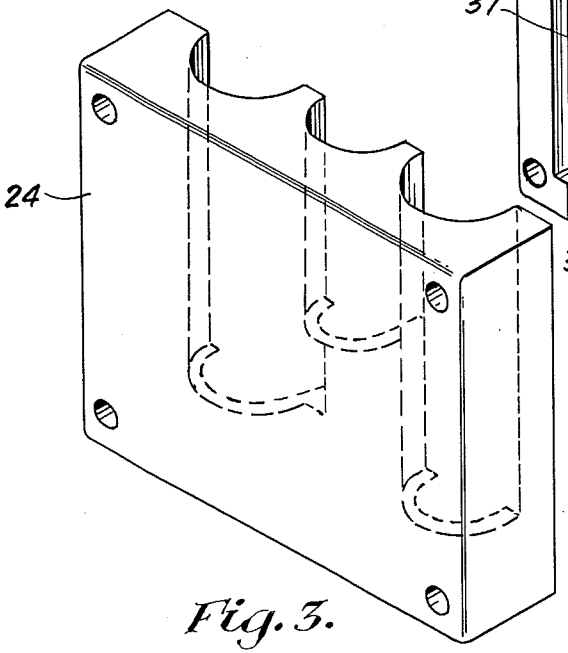
FIG. 3 is an illustration of cavity covering portion of the main body of the apparatus containing the invention.

Reference is now made specifically to FIGS. 2, 3 and 4 which illustrate the details and internal working relationship of the components housed in the main body 11 as well as their physical cooperation with components of the object gripping and positioning mechanism 12. It should be understood that common reference numerals will be used throughout the description of all the Figures whenever the same reference numeral designates the same physical feature.

In FIG. 2 for purpose of illustration the concave opening 19 is shown with the resilient insert 21 of FIG. 1 removed. When FIG. 2 and FIG. 3 are studied in conjunction with each other it becomes apparent that should the lower body portion 16 and cavity cover 24 be brought together as shown assembled in FIG. 1 there would be created a plurality of cavities 36, 37 and 38 so formed. For purposes of illustration these cavities have been referenced with arrows directed to lower body portion 16, but the cavities of course are formed by the physical cooperation of cavity cover 24 and lower body portion 16.

In FIG. 2 it can be seen that the bottom of each cavity 36, 37, 38 there is provided a bottom support land 42, 43 and 44 respectively. These support lands 42, 43, 44 restrict the reciprocating travel of piston shaped control members 61, 62 and object contact member 74 best seen in FIG. 4. The cavities 36, 37, 38 are closed at their upper ends as illustrated and are provided at their lower ends with openings 39, 40 and 41 respectively.

Attention is now directed to FIG. 4. The reader of course should keep in mind that the components shown in FIG. 4 are those that are included in part in the cavities 36, 37, 38, or as in the case of upstanding ears 45, 48 of gripping members 22, 23 these ears 45, 48 extend into and operate through openings 39, 40 and 41 of lower body portion 16.

The cavity 36 contains spring 71 which rests upon spring abutment surface 68 of piston shaped control member 61. The piston shaped contol member has at its lower terminus a slotted opening 63 and a pivot pin aperture 66. The spring 71 is functionally referred to as a resilient control element for reasons that will become more apparent as the description of the invention unfolds. Positioned in cavity 38 is a similar spring 73 resting or cooperating with spring abutment surface 69 of piston shaped control member 62. Control member 62 contains a slot 64 and a pivot pin aperture 67. It can be seen that the two identical arrangements just described form a pair of resilient control elements and control members.

Positioned between this pair of cavities 36, 38 is a cavity 37 in the lower body 16 which contains a spring 72 or resilient control element as it is functionally referred to, and an object contact member 74 which has a head portion 75 for cooperative abutting contact with spring 72. Object contact member 74 passes through the opening 40 and comes into contact with the golf ball or object at various times in the operation of the invention.

It is of primary importance to the operation of the invention that there be recognized that the nature of the resilient characteristics of springs 71, 73 and spring 72 are of differing resiliency. Springs 71, 73 are to be more easily flexed than spring 72 in that the spring configuration of 72 is such that after a short compression movement the spring 72 becomes solid and unyielding while springs 71 and 73 are designed to freely expand and contract depending on the degree of force transmitted to the springs 71, 73 by cooperative physical interaction of the lower body portion 16 as a result of force applied downwardly from the golf club handle 13 during the employment of the invention.

Continuing with the FIG. 4 description, with particular attention to the object gripping and positioning mechanism 12, there are shown a number of components already described in conjunction with the explanation of FIG. 1. There are some additional details that can be more readily appreciated in this Figure. The object gripping member 23 for example has formed therein a golf ball gripping configuration 46 and tee gripping region 47. It should be apparent that the shape of these gripping configurations will depend upon the nature of the object to be grasped or positioned. The detail of FIG. 4 clearly shows ears or upstanding projections 45 and 48 which fit respectively into slots 63, 64 of members 61, 62. A pin not shown passes through pivot pin apertures 66, 67 and pivot pin openings 49 and 50 to thereby establish a pivotal connection.

In the latching mechanism 51 there is detailed a spacing washer 55 between link 53 and ear 48. The spacing washer 55 allows for the free movement of the latching mechanism 51.

Figure 5:
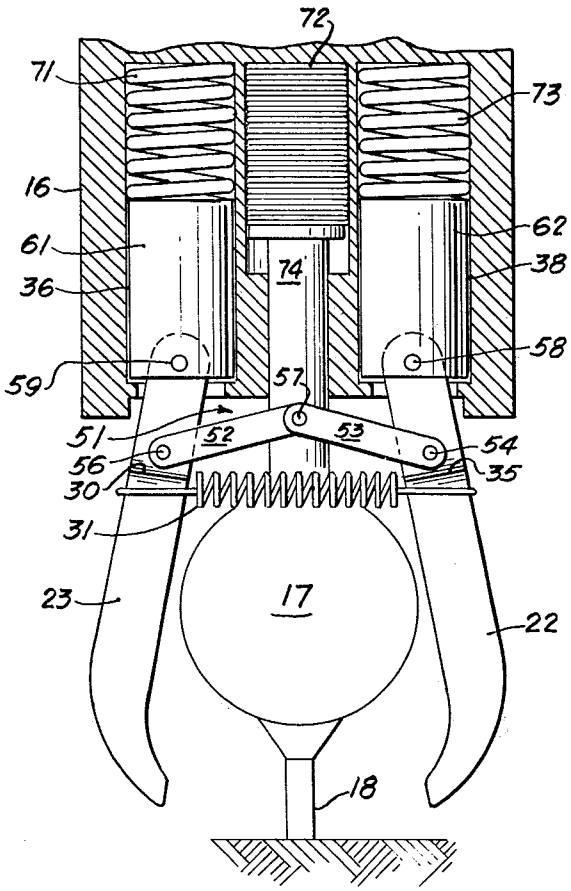
FIG. 5 illustrates a portion of the apparatus containing the invention in an object released position.

Reference is now made to FIG. 5 which illustrates the apparatus embodying the invention in operation at a point in time just after the golf ball 17 has been positioned on a tee 18 in the ground 77 and the apparatus is releasing its grasp.

Figure 6:
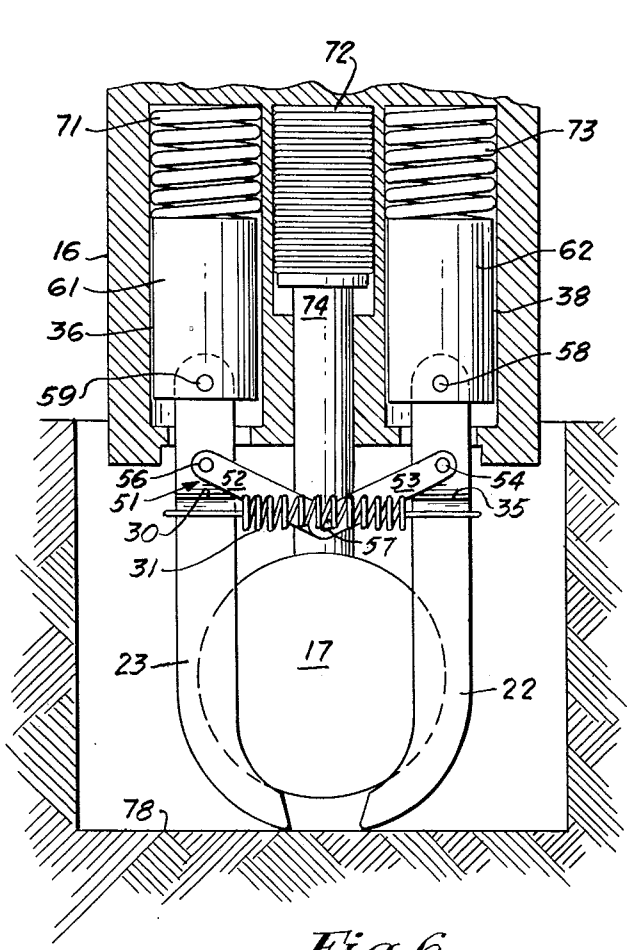
FIG. 6 illustrates a portion of the apparatus containing the invention wherein an object is in the process of being retrieved.

FIG. 6 illustrates the apparatus in a ball retrieving position as for example when the ball 17 is being removed from a cup 78.

In operation it is felt that it is obvious that, as is illustrated in FIG. 1, a ball 17 and tee 18 may be inserted in between the gripping member 22, 23 by a slight manual pressure which will separate the gripping members against the combined spring forces of spring 71, 73 and 31, 32.

Initial downward pressure from the golf club handle not shown in FIG. 5 is transmitted through the lower body portion 16 to the spring 72 and in turn the object contact member 74 to the ball 17. This downward pressure causes the compression of the spring 72 until the ball 17 and tee have been positioned in ball driving or teed condition. Continued downward pressure causes the springs 71, 73 to compress, and the control members 61, 62 begin an upward relative movement in cavities 36, 38. This relative upward movement and the presence of the latching link mechanism causes the gripping arms 22, 23 to move out and away from the ball 17 and finally the pivot members 51 move above a center line passing through pins 54, 56 and with the aid of springs 31, 32 snaps upwardly.

Removing a ball from a cup as shown in FIG. 6 is accomplished by opening the gripping members 22, 23 and allowing the latching mechanism 51 to lock in an open position. In this open position the gripping members 22, 23 are extended into the cup and the ball or object contact member 74 comes into contact with the ball 17 and the continued downward pressure causes the latching mechanism to release and assume the downward position shown.

After the ball has been hit from the tee it is desirable to retrieve the tee if it has not been broken. Sometimes the tee remains in the same position as it was when it was supporting the ball. At other times it may be removed from the ground and land several feet away from its initial position. In either instance the tee may be retrieved in the same general manner as a ball is picked up by the device.

It can be appreciated from the above description that there has been described a contribution to the art that meets a long felt need in a fashion that is unique in its design and simple in its operation and construction.

While the present invention has been illustrated and disclosed in connection with the details of the illustrative embodiment thereof, it should be understood that this illustrative embodiment is only to be limited by the invention as set forth in the accompanying claims.

What I claim is:

1. A portable golf ball teeing and retrieving apparatus for use with a golf ball, tee and golf ball handle comprising a pair of golf ball and tee gripping members, a resiliently biased latching means secured to said gripping members to hold said gripping members in either a golf ball and tee gripping position or a release position, a gripping and position control means mechanically coupled to said members so that initial downward pressure on the gripping and position control means allows said ball and said tee to be positioned with said tee in the ground and said ball positioned thereupon; further downward pressure on said gripping and position control means causes said gripping members to release said ball and tee and additional downward pressure on said gripping and position control means in excess of said initial pressure causes said gripping members to assume a ball gripping position.

2. The portable golf ball teeing and retrieving apparatus of claim 1 wherein said resiliently biased latching means includes a resilient element and latching linkage, which resilient element urges said ball and tee gripping members toward each other when a ball and tee are being gripped and cooperates with said latching linkage to hold said ball and tee gripping member in said release position.

3. A portable object gripping, positioning and retrieving apparatus for use with any elongated unit having a free end of a configuration that will physically cooperate with said apparatus, said apparatus comprised of a main body and an object gripping and positioning mechanism, said main body having an upper and lower portion, said upper portion having a concave opening to provide a mating gripping configuration when said apparatus is pressed into engagement with said free end of said elongated unit, said lower portion having a plurality of cavities suitable for the retention of a plurality of resilient control elements, each of said cavities enclosing a resilient control element, a pair of said cavities having movable control members and a cavity positioned between said pair of cavities having included therein an object contact member, said movable control members and said object contact member are positioned in said cavities in abutting relationship to said resilient control elements for reciprocating movement within said cavities, each of said movable control members having a pivotal connection at a point remote from said control members abutting contact with said resilient control elements, said object gripping and positioning mechanism having a pair of object gripping members, each having a pivotal connection configuration at an upper end which is mechanically coupled to said pivotal connection of said movable control members, said object gripping and positioning members having a lower end provided with an object gripping configuration portion when said object gripping and positioning members are deposed in a substantially parallel relationship, said object gripping and positioning members having connected there between a resilient member, said resilient member urging said object gripping members toward each other to thereby ensure said object is gripped by said object gripping configuration portion of said members, a latching mechanism deposed between and connected to said object gripping and positioning members to provide an open object gripping position, and a closed object gripping position whereby said object is gripped and released depending upon a force transmitted through said apparatus from said elongated unit.

4. The apparatus of claim 3 wherein said concave opening of said upper portion is provided with resilient lining material to facilitate and enhance the gripping of said free end of said elongated unit.

5. The apparatus of claim 4 wherein said concave opening has in part a tapered conical shape to said opening.

6. The apparatus of claim 5 wherein said resilient control element are springs of substantially equal resiliency and length.

7. The apparatus of claim 6 wherein said movable control members reciprocating travel is restricted by the length of the cavity containing each resilient control element and control member.

8. The apparatus of claim 7 wherein said cavity positioned between said pair of cavities containing said resilient control elements and control member has a resilient control element having a greater resistance to compression than said resilient control element for said control members, said cavity position between said pair of cavities having a length shorter than the length of said pair of cavities, thereby providing said object contact member with a shorter allowable physical travel while simultaneously providing a resilient resistant force in excess of the force necessary to compress said resilient control elements in abutting contact with said movable control members.

9. The apparatus of claim 8 wherein said latching mechanism is comprised of a pair of links pivotally connected to each other at one end of each link and pivotally connected to said object gripping and positioning members at their respective other ends, the combined lengths of said links having a total length greater than the distance between said object gripping and positioning members when said object gripping and positioning members are in said substantially parallel relation when an object has been gripped.

10. The apparatus of claim 9 wherein said object gripping configuration lower end portion is of a shape that provides for a simultaneously mating engagement with a golf ball and tee.

* * * * *